US006991504B1

(12) United States Patent
English et al.

(10) Patent No.: US 6,991,504 B1
(45) Date of Patent: Jan. 31, 2006

(54) SURFBOARD FIN MOUNTING SYSTEM

(76) Inventors: James A. English, 497 Orpheus St., Leucadia, CA (US) 92024; Richard G. Belitz, 5580 Lake Park Way #12, La Mesa, CA (US) 91942

( * ) Notice: Subject to any disclaimer, the term of this patent is extended or adjusted under 35 U.S.C. 154(b) by 0 days.

(21) Appl. No.: 10/919,055

(22) Filed: Aug. 16, 2004

(51) Int. Cl.
*B63B 1/00* (2006.01)

(52) U.S. Cl. ..... 441/79; 114/127

(58) Field of Classification Search ..... 441/79; 114/127

See application file for complete search history.

(56) References Cited

U.S. PATENT DOCUMENTS 4,044,416 A * 8/1977 Brewer et al. ..... 441/79
4,421,492 A * 12/1983 Leva ..... 441/79
4,701,144 A * 10/1987 DeWitt, III ..... 441/79
4,964,826 A * 10/1990 Lobe ..... 441/79
5,215,488 A * 6/1993 Bailey ..... 441/79
5,934,963 A * 8/1999 Frizzell ..... 441/79
6,695,662 B2 * 2/2004 Kelley ..... 441/79

* cited by examiner

*Primary Examiner*—Jesus D. Sotelo
(74) *Attorney, Agent, or Firm*—Richard D. Clarke

(57) ABSTRACT

Provided is a system including a fin box that allows surboard fins to be installed, removed or adjusted to the front or rear of the board within the box and a means for installing the box on the surfboard. More importantly, the fins can be installed in the fin box, and adjusted or removed from the fin box without the use of tools. By using the fin box installation system, manufacturers can effectively locate, align and install the fin box on the surfboard. More importantly, the manufacturers are able to lean and rotate the fins precisely at any desired angles and achieve precise and critical symmetrical mounting of the fins with relation to the centerline of the surfboard.

24 Claims, 4 Drawing Sheets

SURFBOARD FIN MOUNTING SYSTEM

FIELD OF THE INVENTION

This invention relates to the field of aquatic sports equipment, in particular to the construction of surfboards or other surf riding devices where a controlling fin or multiple fins are attached to the rear underside of the body structure of the device. In some cases these controlling fins protruding from the underside of surfboards have been called skegs. This invention provides a means of attaching fins to the surfboard in such a way that they can be removed, replaced or adjusted by the user without the use of any tools by means of a unique fin box that secures the fins to the surfboard and a unique system for installing the fin box on the surfboard.

BACKGROUND OF THE INVENTION

Surfing is a thrilling water sport for persons of all ages. In surfboard riding, the surfer stands on a board that skims across the front of a wave. For a surfboard ride, the surfer lies on his stomach on the board and paddles out to the area where the waves build up. When a big wave starts in toward shore, the surfer paddles his board ahead of it. As the wave begins to carry the board toward shore, the surfer stands up. He tries to guide the board across the face of the wave by shifting the weight of his body and pivoting the board about the fin or fins at the rear underside of the surfboard. Expert surfers may move to the front of the board, but most surfers stand at the middle or rear of the board to keep it from turning over. A long rolling wave will bring a surfer onto the sands of the shore. The bigger the wave, the better the ride will be.

Surfing began in Hawaii hundreds of years ago. The sport is now popular in most parts of the world. Surfing in the United States centers on the beaches of Hawaii, California, and the east coast. Many styles of surfboards are used, but most U.S. surfers use a fiberglass board that is tapered at both ends with one or more fixed or removable controlling fins at the underside of the back of the surfboard. It is about 6½ feet (2 meters) long, 20 inches (½ meter) wide, 2 ½ inches (8 centimeters) thick, and weighs about 9 pounds (4 kilograms.) These dimensions may vary widely depending upon the type of board, the size of the waves and the size and skill of the surfer.

Fin mounting systems (mounting boxes) that allow the removal of fins have been a common feature of surfboards for a number of years. This feature provides several benefits, for example, broken fins can be easily replaced, fins of different designs can be used interchangeably on the same board, and fins can be easily removed for storage or transportation to save space and reduce the risk of breakage. Some mounting systems allow the adjustment of fins forward and rearward, which is advantageous because it allows fine-tuning of the performance of the surfboard. Existing designs require some form of tool to install or remove fins, which is a drawback.

Surfboards typically have three fins and mounting boxes. The installation of mounting boxes during surfboard fabrication is somewhat difficult due to the following considerations. The precise location and alignment of the fins (and, therefore, of the mounting boxes) is critical to performance-all three fins are generally pointed at the nose of the board, and the outer fins generally angle outward. The bottom surface of the board is generally curved, complicating alignment. Keeping the mounting compound out of the fin cavity is also critical and is generally accomplished with masking tape. Existing mounting boxes employ various fixtures and masking tape for alignment.

This invention describes a new and unique surfboard fin mounting box that will allow fin installation, removal and adjustment forward and rearward without tools, and a fin-box installation system that will solve the numerous problems incurred when manufacturing surfboards.

While the present invention has been described herein with reference to particular embodiments thereof, a latitude of modification, various changes and substitutions are intended in the foregoing disclosure, and it will be appreciated that in some instance some features of the invention will be employed without a corresponding use of other features without departing from the scope of the invention as set forth.

REFERENCES CITED

U.S. Pat. No. 4,044,416 of Charles A. Bower describes a fin for a surfboard that has a longitudinal fin base. A fin holder in the underside of the surfboard defines an elongated channel extending lengthwise of the surfboard for receiving the fin base for lengthwise adjustment of the fin relative to the surfboard. A clamp is slidable lengthwise in that channel and is engageable with the fin holder and the fin box for releasably retaining the fin relative to the surfboard.

This patent describes a fin mounting box in the early stages of development when most surfboards only had a single fin in the rear and it had to be perpendicular to the centerline of the surfboard. This patent does establish the longitudinal adjustment of the fin with a bifurcated locking means but does not provide the unique installation capabilities and cam action locking means so disclosed within this patent.

U.S. Pat. No. 4,320,546 of Charleton R. Knox discloses a surfboard with a fin that has been developed to counteract the tendency for skegs or fins to "pop out" especially when the surfer "walks the nose" of the surfboard or rides high on a wave. The fin has a pair of opposed wing hydrofoils extending laterally from an approximately mid-point position on a vertical hydrofoil having a forwardly arcuate relieved portion above the wing hydrofoils, a downwardly-rearwardly swept leading edge and a rearwardly-upwardly swept trailing edge terminating at the confluence of the rear edges of the wing hydrofoils.

This patent dwells with the unique hydrofoil shape of the fin with a screwdriver required to remove the fin from the fin mounting box. It does not indicate distinctive installation features of the fin box into the surfboard or the unique cam locking features, not requiring any tools to remove the fin from the surfboard.

U.S. Pat. No. 4,379,703 of James A. Mizell describes an apparatus for securing a fin to the bottom surface of a surfboard and comprising a uniquely configured fin box designed to provide a more secure structural relationship between the fin box and the surfboard. The fin box of the present invention provides an angularly oriented securing means at one end of the fin, which permits reliable but readily removable means for securing the fin within the fin box. Furthermore, the present invention provides a more positive securing means for the fin itself comprising a diagonally or angularly configured aperture for receiving a fastening device which replaces at least one of the laterally disposed pins of the prior art whereby a threaded screw may be used to positively secure the fin with sufficient retention within the box while still permitting ready removal of the fin only when it is desired.

This patent dwells with the improvement of an existing patent and does not offer the unique installation system for positive alignment of the fin mounting box within the surfboard or the cam action locking means requiring no additional tools for removal of the fin from the surfboard.

U.S. Pat. No. 4,804,347 of Melvin C. Ross tells of a structure for mounting fins to the under side of a surfboard that includes an elongated molded fin socket member which defines an interior rectangular slot configured to receive a rectangular base of a fin member. The fin socket further defines an upwardly extending cover recess coextensive with the slot. The fin socket is adhesively secured within a contoured recess within the surfboard foam core prior to the laminating operation. After the surfboard has been laminated with the fin socket in place such that the laminating materials overlap the fin socket, the upwardly extending portion of the fin socket is removed and ground flush to the laminated surface of the surfboard to expose the rectangular slot. Thereafter, the fin is adhesively secured within the slot.

This patent describes a fin mounting box installed within a surfboard having the fin permanently installed with adhesive. It does not describe the unique positive alignment and positioning features of the soindisclosed invention nor does it offer the adjustability of the fin with the can locking means.

U.S. Pat. No. 5,215,488 of Steven J. Bailey discloses an essentially flat parallelogram-shaped locking nut with rotational biasing spring as part of a locking device attached to a supporting tongue of a nautical fin for water craft such as sailboards, where their hulls or keels either contain or may be modified to contain an elongated channeled mounting box with internally recessed lateral grooves for receiving said nut and thereby locking the fin to the hull.

This patent though specified for sailboards would work equally well on surfboards, but does not offer the unique mounting system of the fin mounting box within the surfboard and requires a separate tool to adjust or remove the fin from the fin box.

U.S. Pat. No. 5,328,397 of Brian A. Whitty details a system for attaching fins to surfboards and other surf craft utilizes fixing elements embedded in the body of the board, these elements having slots which receive tabs extending from the end of the fin. The tabs are secured by grub screws enabling the fins to be removed upon damage or for transport.

This patent describes a system of installation not requiring the fin mounting box but instead uses a fixing element embedded into the body of the surfboard to retain the fin. Exact positioning and alignment of these embedded elements would take an entirely different locating means differing completely from this patent or others using the conventional fin mounting box.

U.S. Pat. No. 5,464,359 of Brian A. Whitty describes a system for attaching fins to surfboards and other surf craft utilizes fixing elements embedded in the body of the board, these elements having slots which receive tabs extending from the end of the fin. The tabs are removably secured by grub screws enabling fins to be removed for transport or upon damage.

This second patent for Whitty utilizes grubbing screws as a means of attaching the fin within the embedded element of the surfboard. It does not allow for exact angular positioning of the embedded element within the board at assembly and requires a tool for the removal or adjustment of the fin on the surfboard.

U.S. Pat. No. 5,830,025 of Marc W. Fleming tells of a fin box for a water sports board including an elongate socket and a flange that extends laterally from the elongate socket. The socket includes a central elongate cavity and a raised lip about the cavity. The elongate, socket also includes an oblong cylindrical outer surface. A ramp extends between the raised lip and the flange. The lip includes a surface to receive sealing tape employed for the laminating process. A setscrew assembly provides for locking of a fin within the central elongate cavity. Gussets extending between the flange and the elongate socket provide dimensional stability and locational strength as well as serrations for easy insertion into the foam core of a water sports board, The fin box is able to accommodate positioning within a coating of resin in a socket in the foam core of a water sports board with laminating of the board occurring immediately. The cavity is then exposed through grinding.

This patent deals specifically with design of the fin mounting box while still using the setscrew assembly for locking the fin within the channel. This locking means requires a special tool for removal or adjustment that surfers must have available. If this fin box was used where the fin was angled, one side of the mounting flange would have to be removed. The mounting box does not have any means for precise angular adjustment at the time of assembly to the surfboard.

U.S. Pat. No. 5,934,962 of Terry R. Daum discloses a shallow draft surfboard fin socket for locating in a recess formed in the bottom of a surfboard at the time of manufacturing.

This fin mounting box has no lateral adjustment to the fin that is held in place by a small clip at the back of the fin. This fin mounting box has flanges along both sides that are perpendicular to the fin and adjacent to the under surface of the surfboard that will restrict any angular tipping of the fin commonly occurring when more than one fin is used on a surfboard.

U.S. Pat. No. 5,975,974 of William Thomas McCausland tells of a surf fin fixing system for a surf craft that comprises one or more embedded fixing elements with fixing cavities, which receive fixing formations of the fin. The fixing element includes a cam with a generally horizontal axis parallel to the fin and actuating means causing the cam to apply force to the fixing formation and thus lock the fin onto the surf craft.

This patent does not incorporate the conventional fin mounting box but uses one of more fixing elements and a horizontal cam actuated rod that is parallel to the fin to press and hold the fin in position. Additionally this patent does not incorporate any precise angular positioning device to be used to set precise angles and position of the fin location on the surfboard.

Consequently there exists a need for an apparatus and system, which will be used to precisely locate the position of the fin mounting box and to be used as a router jig for removing the material to create the cavity for the insertion of the fin mounting box. Incorporated with the router jig is a fin angle position protractor to precisely locate the fin box in position and hold it at any desired angle as the fin box mounting compound hardens.

None of the foregoing prior art teaches or suggests the particular cam-locking feature used to position and lock the fin in place requiring no additional tools or deals with the system involved with the installation of the fin box into the surfboard or the precise setting of adjustment of the fin angles.

SUMMARY OF THE INVENTION

The principal object of this invention is to create a fin box where the surfboard fin can be adjusted forward or aft, installed, removed or replaced by hand without requiring any additional tools, and a means for installing the fin box on a surfboard.

Another object of this invention is to create a surfboard fin mounting box where the fin is locked in place with a hand operated cam locking or wedge locking means.

Another object of this invention is to create a fin box where forces exerted on the fin are exerted distributed along the fin box central slot cavity and not concentrated on the locking mechanism.

And still another object of this invention is to create a surfboard fin box that may be mounted at various angles with relation to the surface of the surfboard during the installation process.

Yet another object of this invention is to create an installation system whereby a router jig is used to remove the material from the surfboard for the fin mounting box with a conventional router.

And yet another object of this invention is to use that same router jig to locate the fin box and to serve as a "dam" to confine the mounting resin.

A further object of this invention is to use an adjustable fin angle position protractor attached to the router jig for precise angular alignment of the fin box.

And still a further object of this invention is to use this tooling to hold the fin box in position while the fin box is installed on surfboard bottoms with compound cures.

And another object is that the fin box locator will prevent mounting resin from entering the fin box during installation.

A final object of this invention is to improve the manufacturing processes in making surfboards along with an improved surfboard fin box and adjustable fin.

A general description of the fin box is as follows. The box has a central slot, which receives a mating boss at the root of the fin. One end of the fin has small, lateral pegs, which engage in corresponding lateral "T" slots at corresponding end of the central slot. These slots affix one end of the fin at the correct position relative to the surface of the board, while allowing the fin to move forward and aft within the central slot.

At the other end of the fin box is a locking device to secure the fin to the board. This device, when engaged, fixes that end of the fin relative to the surface of the board. Also, in conjunction with the lateral pegs, the locking device forces the center the fin boss into contact with the bottom of the central slot in the mounting box creating friction, which prevents forward-or-backward movement of the fin in the mounting box. Mating teeth on the contact areas of the fin and box may be added to augment the friction.

The preferred configuration is described in FIG. 1. In this configuration transverse pegs are at the front of the fin, and the locking mechanism is at the rear. There is a T-slot in the front to the box for the transverse fin-pegs, and a second T-slot in the rear for the locking mechanism. The locking mechanism consists of (a) a lever with non-circular, lateral pegs with specific cam profiles, (b) a cantilevered protrusion at the rear of the fin, and (c) the rear T-slot, and (d) a plurality of grooves along the base of the central slot cavity that engage with one or more mating ridges along the lower surface of the mating boss at the root of the fin thereby securing the fin in the desired fore-aft location.

The lever is captured in the rear T-slot but is free to move forward and aft and to rotate about an axis perpendicular to the plane of the fin. In the "open" position, the lever protrudes out of the board about 90°; in the "lock" position the lever has been rotated into the slot.

The fin is installed as follows. First, with the surfboard upside down, the transverse pegs of the fin are inserted into the forward T-slot through a port at the rear of the T-slot, and the fin is then "loaded" by moving it forward and down into the central slot. Second, with the lever in the "open" position, the locking mechanism is "armed" by moving the lever forward until it engages with the cantilevered protrusion at the rear of the fin and then forcing the lever over a bump on the fin and into a detent. Once armed, the fin is free to move forward and aft, but it cannot be removed from the slot. Third, the fin is located in the desired forward-aft location. And fourth, the lever is rotated down into the slot to "lock" the fin in position.

In the "locked" position the cam-pegs of the lever force the cantilevered protrusion of the fin down, which in conjunction with the forward fin-pegs, forces the center of the fin against the center of the fin-box to engage the mating ridges and prevent movement.

The lever is restrained in the "locked" position in two ways: (a) a detent in the cam of the lever mates with corresponding protrusion in the fin when locked, and (b) a protrusion on the side/rear of the lever interferes slightly with the wall of the central slot and "catches" in the T-slot when locked.

The locking mechanism can easily be locked with finger pressure. By design, un-locking is more difficult, but it can be unlocked with a fingernail (or any object such as key, nail, stick or seashell.)

The amount of travel is determined by (a) the difference between the length of central slot and the combined length of the fin and the lever when engaged in the locked position and (b) the length of each of the T-slots. This configuration allows about one-half inch of forward-backward travel.

Other design configurations are also covered such as the following:

a) Similar to FIG. 1, but with a locking lever that rotates about an axis perpendicular to the surfboard.
b) Similar to FIG. 1, but with a locking lever that rotates about an axis parallel to the intersection of the fin and the surfboard.
c) Similar to FIG. 1, but with a sliding wedge instead of a rotating lever to provide the locking action.
d) Similar to any of the above, but with the locking mechanism in front and the lateral pegs at the rear of the fin.

A second embodiment of the locking device employees a pivoting cam member to force the locking arm of the fin mating boss against the base of the central slot cavity, while a third embodiment employees a wedge locking member to force the locking arm of the fin mating boss against the base of the central slot cavity.

This device, when engaged, fixes that the end of the fin relative to the surface of the board and the fin is rigidly held in place. The locking device can be either at the front or the rear of the mounting box with the locking device consisting of one or more parts and the locking action consisting of a rotating element, a pivoting element or sliding element and still remain within the scope of this patent.

In the preferred configuration, the fin is installed as follows. First, with the surfboard upside down, the transverse pegs of the fin are inserted into the forward T-slot through a access groove at the rear of the T-slot, and the fin is then "loaded" by moving it forward and down into the central slot. Second, with the lever in the "open" position, the locking mechanism is "armed" by moving the lever forward until it engages with the cantilevered protrusion at the rear of the fin and then forcing the lever over a bump on the fin and into a detent. Once armed, the fin is free to move forward and aft, but it cannot be removed from the slot. Third, the fin is located in the desired forward-aft location. And fourth, the lever is rotated down into the slot to "lock" the fin in position. In conjunction with the lateral pegs, the locking device forces the center the fin boss into contact with the bottom of the central slot in the fin box, and prevents forward or backward movement of the fin in the fin box.

The fin box-installation system consists of three components: the router-jig/mounting-base, fin angle position protractor, and the fin box locator.

The router-jig/mounting-base is configured to be used to rout-out the fin-box cavity with two "V" grooves located at either end to locate the centerline of the router-jig/mounting base and thereby the fin box in the desired relationship to the centerline axis of the surfboard. Locating orifices on the router jig are positioned to mount the legs of the adjustable fin angle protractor. The router jig with the adjustable fin angle position protractor and fin box locator in place is then used to determine the exact angle of the fin when the central slot cavity insert is inserted into the central slot cavity of the fin box. The angle alignment gage determines the desired angle of the fin by adjusting with relation to the angular position grooves in the adjustable fin angle protractor. Fin mounting box-mounting compound is then inserted into the mounting cavity and the fin box is inserted.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent construction insofar as they do not depart from the spirit and scope of the present invention.

These together with other objects and advantages which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF THE DRAWINGS

The accompanying drawings, which are incorporated in and form a part of this specification, illustrate embodiments of the invention and together with the description, serve to explain the principles of this invention. Unless otherwise identified, they refer to the preferred embodiment.

DETAILED DESCRIPTION OF THE PREFERRED EMBODIMENTS

Figure 1:
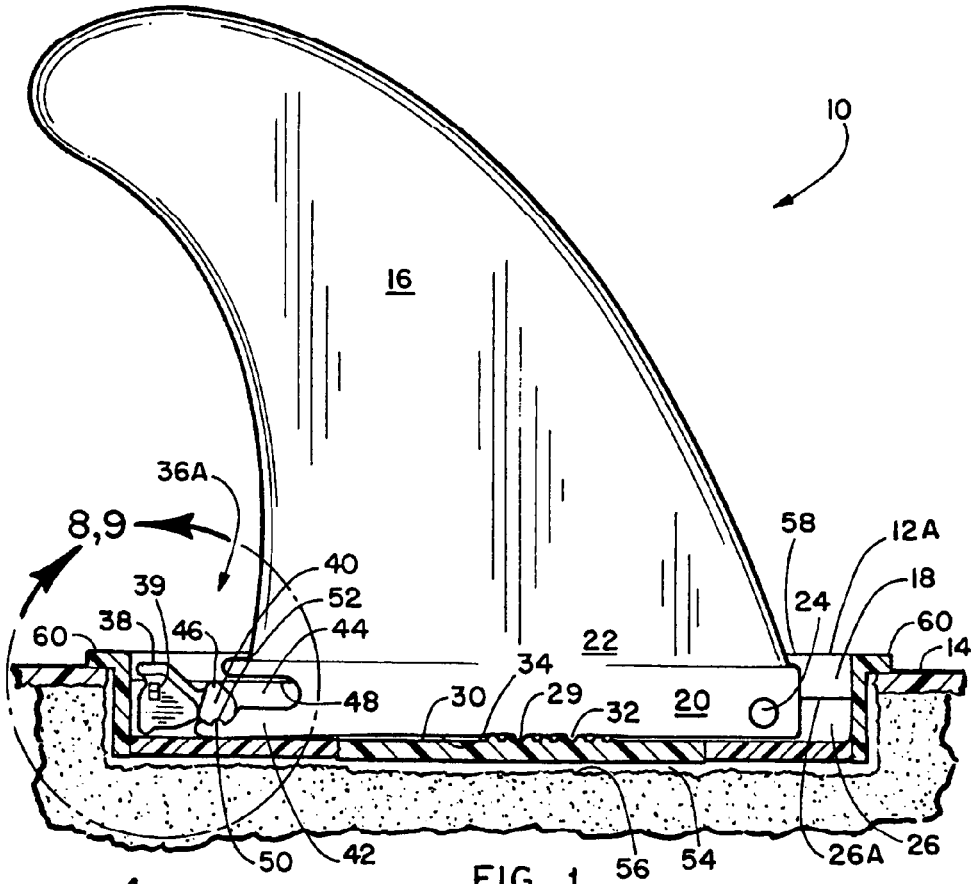
FIG. 1 depicts a side elevation of a surfboard fin box installed in a surfboard with the fin in place.

Referring now to the drawings, wherein similar parts of the surfboard fin box and installation system 10 are identified by like reference numerals, there is seen in FIG. 1 a side elevation of a surfboard fin box 12A in cross section, installed in a surfboard 14 with the fin 16 in place. A central slot cavity 18, receives a mating boss 20 at the root 22 of the fin 16. The "loading" end of the fin 16 has two small, lateral pegs 24, which engage in corresponding lateral peg "T" slot 26 at the distal end 28 of the central slot cavity 18. This lateral peg "T" slot 26 retains one end of the fin 16 at the desired position relative to the surface of the surfboard 14, while allowing the fin 16 to move forward and aft within the central slot cavity 18. A plurality of grooves 29 along the base of the central slot 30 mate with one or more mating ridges 32 along the lower surface 34 of the mating boss 20 at the root 22 of the fin 16. This increases the resistance of the fin 16 to forward or rearward forces so that the fin 16 is less likely to be dislocated from the desired fore-aft location.

At the other (or "locking") end of the fin box 12A is a cam action locking device 36A to secure the fin 16 into the fin box 12A within the surfboard 14. This preferred embodiment of the cam action locking device 36A uses a cam action lever 38 to rotate a lateral cam member 40 into a locking position that forces a locking arm 42 on the fin mating boss 20 further into the locking "T" slot 44 by pressing the lateral cam member 40 against the inner surface 48 of the locking "T" slot 44 and forcing the locking arm 42 of the fin mating boss 20 in the direction of the base 30 of the central slot 18. This pressure, in conjunction with the force between the lateral pegs 24 and the inner surface 26*a* of the lateral peg "T" slot 26 locks the ridges 32 along the lower surface 34 of the mating boss 20 of the fin 16 with the grooves 28 along the base of the central slot 30 to resist forward or rearward movement of the fin 16. Lobe 46 creates by cam action the locking pressure against the upper surfaces 48 of the locking "T" slot 44 while the lateral cam member 40 having depression 50 engages with raised detent 52 in the surface of locking arm 42 to secure cam action lever 38 in the locked position. Cam action locking device 36A contains a locking tab 39 to prevent cam lever 38 from upwardly disengaging from position within fin box 12A. It must be made clear that the length of the fin box 12A and the length of the central slot cavity 18 may vary depending upon the desired forward and aft movement of the fin 16, and that the cam action locking device 36A can also be at the forward end of the mating boss 20 with the lateral pegs at the aft end and still remain within the intended scope of this patent.

FIG. 1 additionally displays the fin mounting box 12A mounted in the surfboard 14 by the means of a fin box-mounting compound 54 within the mounting cavity 56. The top edge 58 of the fin box 12A along with the pivoting tabs 60 will be removed at conclusion of the manufacturing process.

Figure 2:
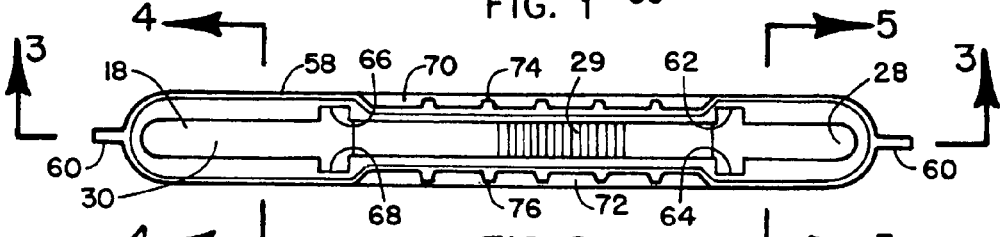
FIG. 2 depicts a plan view of the fin box.

FIG. 2 depicts a plan view of the fin box 12A with the fin 16 removed to clarify the shape of the central slot cavity 18 also showing the plurality of grooves 29 on the base of the central slot 30. At the forward end of the central slot cavity 18 are two apposing access grooves 62 and 64 to function as a means to insert the lateral pegs 24 when inserting the forward end of the fin 16 with the lateral pegs 24 into the lateral peg "T" slot 26 within the central cavity 30. At the aft end of the central slot cavity 18 are a second opposing set of access grooves 66 and 68 for the insertion of the lateral cam member 40 of the cam action locking device 36A. Both sets of opposing access grooves, 62, 64 and 66, 68 are covered by the mating boss 20 of the fin after it has been inserted into the central slot cavity 18 and slid forward.

The two pivoting tabs 60 provide pivot points along a common centerline on the fin box 12A so that the angle of the fin 16 may be adjusted. These pivoting tabs 60 rest on the distal edges of the mounting cavity 56 on the finish surface of the surfboard 14. The top edge 58 that goes around the upper periphery of the fin box 12A works as a dam to keep the resin used in surfacing the surfboard and the fin box mounting compound 54 from entering the central slot cavity 18. Both the top edge 58 and the pivoting tabs 60 are removed at the completion of the installation process normally by sanding. Recessed areas 70 and 72 with multiple ribs 74 and 76 along the sides of the fin box 12A and adjacent to the plurality of grooves 28 on the base of the central slot 30, aide to encapsulate and strengthen the fin box 12A when the fin box-mounting compound 54 is inserted between the fin box 12A and the mounting cavity 56.

Figure 3:
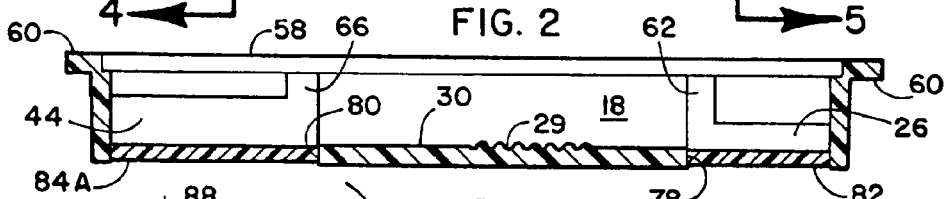
FIG. 3 depicts a sectioned side elevation of the fin box.
Figure 4:
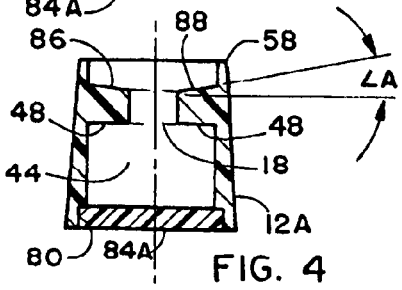
FIG. 4 depicts a section through the fin box at the location of the lateral locking "T" slot.
Figure 5:
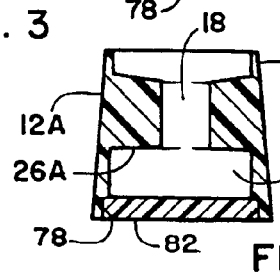
FIG. 5 depicts a section through the fin box at the location of the lateral peg "T" slot.

FIG. 3 depicts a sectioned side elevation of the fin box 12A illustrating the pivoting tabs 60 and the top edge of the fin box 58. The access groove and lateral peg "T" slot 26 along with the access groove 66 and the locking "T" slot is further clarified. Openings 78 and 80 are required by the injection molding process to create the central slot cavity 18 and filled with segment 82 and 84 at the fin box manufacturing process. FIG. 4 depicts a section through the fin mounting box 12A at the location of the lateral locking "T" slot 44. This view further clarifies the Locking "T" slot 44 and the upper surfaces 48 where the pressure is exerted by lobe 46 of cam action lever 38. Surfaces 86 and 88 are shown tapered inwardly toward the center of the central slot cavity 18 at angle "A" most commonly, but not limited to 11 degrees. This angle "A" is the angle used when leaning the fin 16 to one side or the other when two or more fins 16 are used on a surfboard. FIG. 5 depicts a section through the fin box 12A at the location of the lateral peg "T" slot 26.

Figure 6:
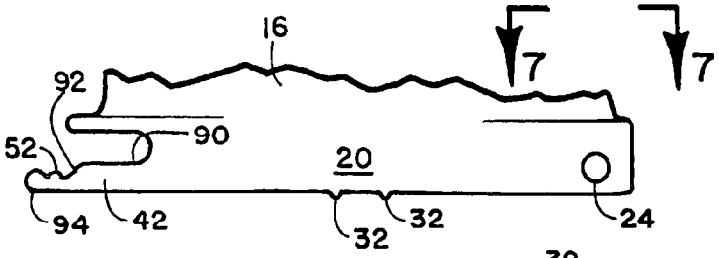
FIG. 6 depicts a side elevation of the mating boss at the root of the fin.
Figure 7:
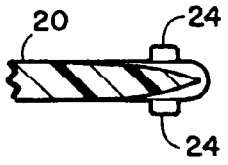
FIG. 7 is a section through the forward end of the fin illustrating the lateral pegs.
Figure 8:
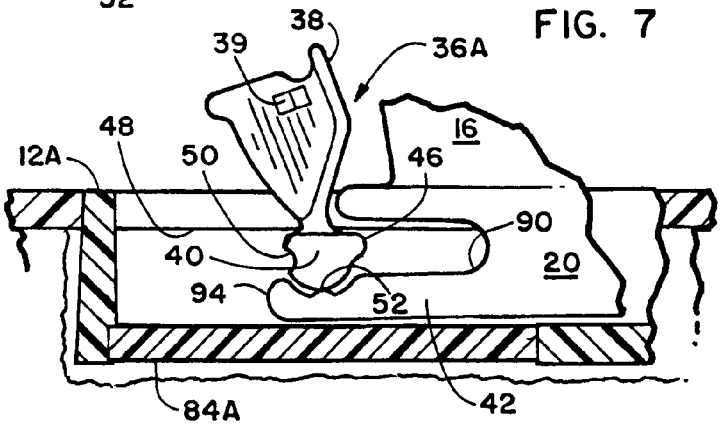
FIG. 8 depicts a section through the side of the fin mounting box with the cam action lever "armed" prior to being locked.
Figure 9:
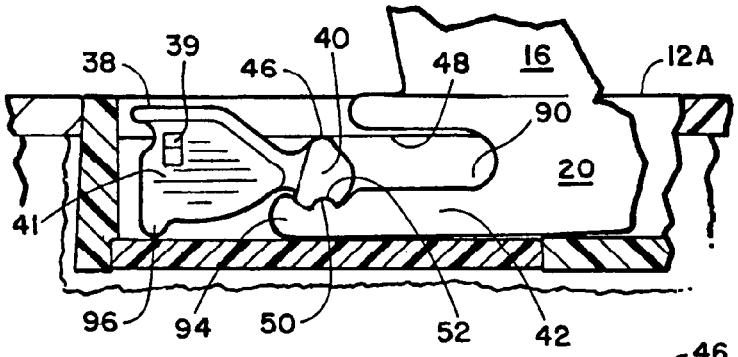
FIG. 9 depicts a section through the side of the fin mounting box with the cam action lever fully engaged in the locked position.
Figure 11:
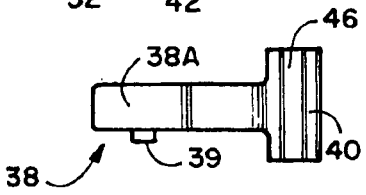
FIG. 11 depicts a plan view of the cam action lever.
Figure 10:
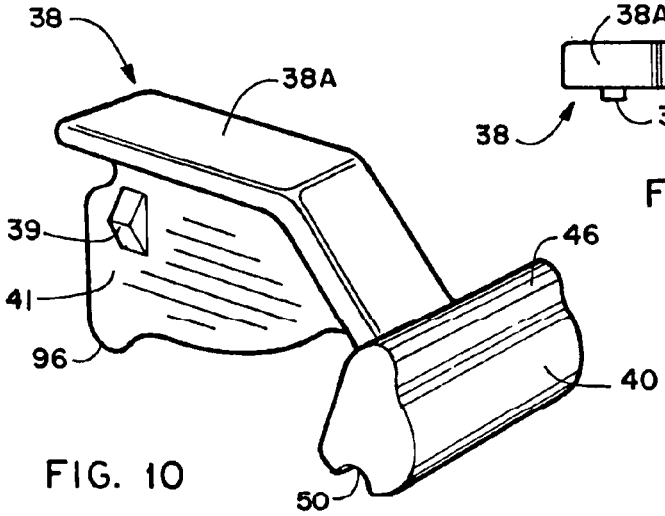
FIG. 10 depicts a perspective view of the cam action lever.

FIG. 6 depicts a side elevation of the mating boss 20 at the root of the fin 16 with the lateral pegs 24 shown at the forward distal end, the mating ridges 32 on the on the lower surface 34 and the locking arm 42 shown at the opposite end created by the recessed area 90. At the distal end 94 of the locking arm 42 is a radial groove 92 with a raised detent 52. FIG. 7 is a section through the forward end of the fin mating boss 20 illustrating the lateral pegs 24. FIG. 8 depicts a section through the side of the fin box 12A with the cam action lever 38 "armed" in the up position, prior to being locked where the fin can easily be moved forward and back to any desired position. This view illustrates the lobe 46 in a neutral position not pressing against the upper surface 48 of the locking "T" slot 44. FIG. 9 depicts a section through the side of the fin box 12A with the cam action locking device 36A having the cam action lever 38 fully engaged in the locked position with the lobe 46 pressing against the upper surface 48 of the locking "T" slot 44. The orifice 50 is shown in full engagement with the raised detent 52 securing the cam action lever 38 into position. An additional stop 96 on the cam action lever 38 works as a stop to keep the rotation of the cam action lever 38 from going past the "locked" position of the raised detent 52 and the orifice 50. FIG. 10 depicts a perspective view of the cam action lever 38 with the lateral cam member 40 having the lobe 46, the locking arm 38*a* the orifice 50 and the stop 96. FIG. 11 depicts a plan view of the cam action lever 38 depicting the "T" configuration that locks it within the locking "T" slot 44.

Figure 12:
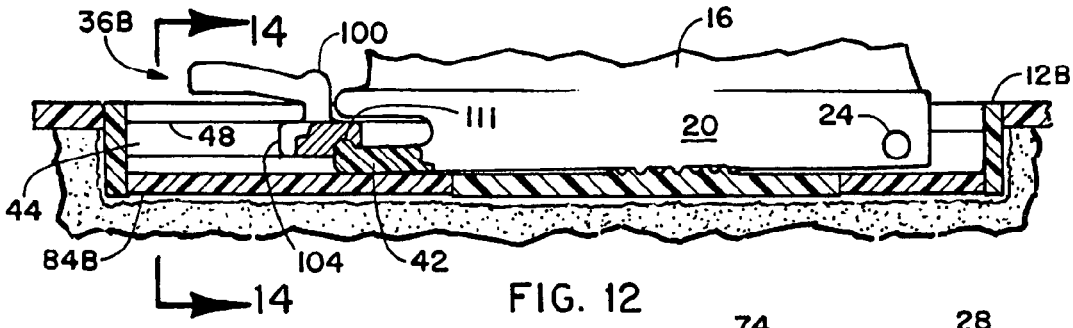
FIG. 12 depicts a section through the side of the first alternate embodiment of the fin box using a rotational cam locking device.
Figure 13:
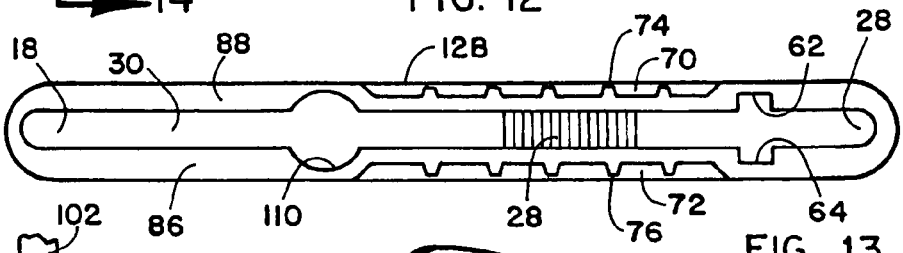
FIG. 13 is a plan view of the first alternate embodiment of the fin box.
Figure 14:
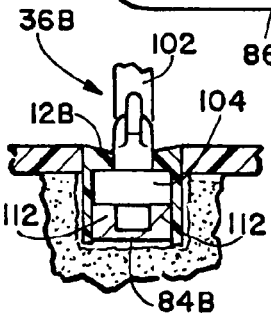
FIG. 14 is a section through the first alternate embodiment of the fin box illustrating the rotational cam locking device.

FIG. 12 depicts a section through the side of the first alternate embodiment of the fin box 12B using a rotational cam locking device 36B. The rotational cam locking device 36B uses a pivoting cam member 100 that has a handle 102 to rotate a disk element 104 having a detent entry slot 106 and a radial inclined groove 108. The disk element 104 is inserted through a circular entry orifice 110 into the locking "T" slot 44 with the detent entry slot 106 adjacent to the locking arm 42 incorporating a circular detent 111. When the fin 16 is slid back to the pivoting cam member 100 the radial inclined groove 108 comes in alignment with the circular detent 111 and then pivoting by the means of the handle 102 the pressure is exerted on the upper surface 48 of the locking "T" slot 44. The sides of the segment 84B are extended to support the disk element 104. FIG. 13 is a plan view of the first alternate embodiment of the fin box 12B indicating the circular entry orifice 110 by which the disk element is inserted into the locking "T" slot 44. FIG. 14 clarifies the extended sides 112 on the segment 84*b* required to support the disk element 104.

Figure 15:
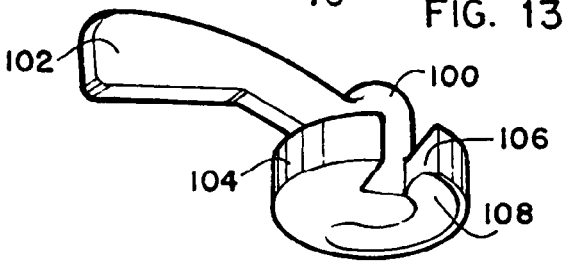
FIG. 15 is a perspective view of the rotational cam locking device.
Figure 16:
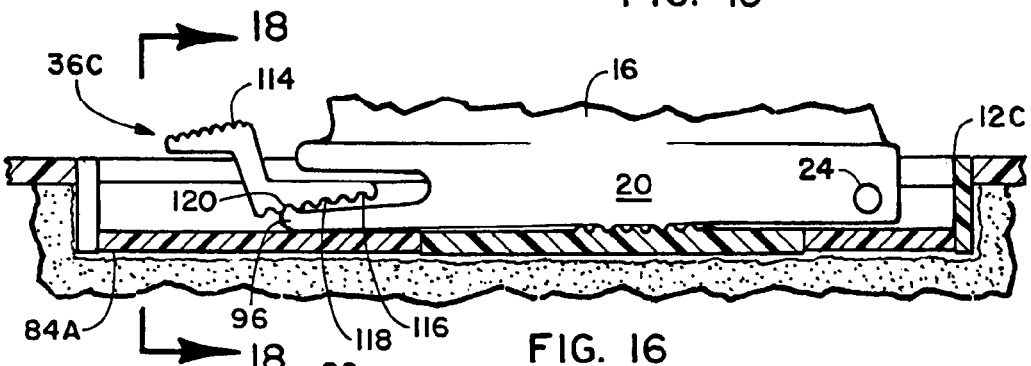
FIG. 16 is a section through the second alternate embodiment of the fin box using the sliding wedge locking device.
Figure 17:
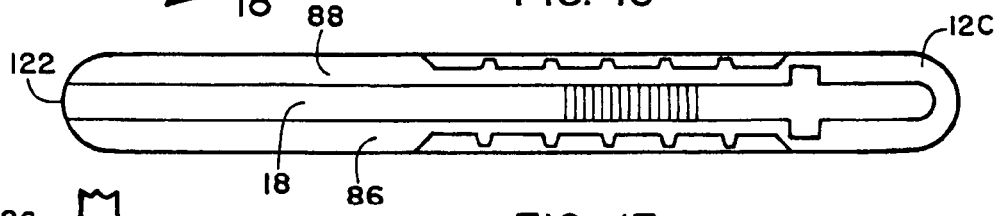
FIG. 17 is a plan view of the second alternate embodiment of the fin box.
Figure 18:
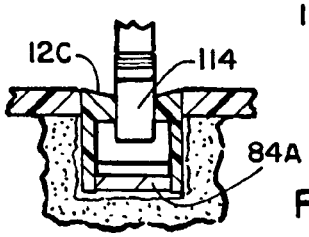
FIG. 18 is a section through the second alternate embodiment of the fin box illustrating the wedge locking device.

FIG. 15 depicts a perspective view of the rotational cam locking device 36B. FIG. 16 depicts a section through the second alternate embodiment of the fin box 12C using a locking device 36C. This device uses a wedge locking member 114 with grooves 116 along the lower surface 118 to engage a ridge 120 on the distal end 96 of the locking arm 42 on the mating boss 20 of the fin 16. The pressure exerted when the wedge locking member is pushed into the recessed area 90 is applied to the upper surface 48 of the locking "T" slot 44 which intern presses the locking arm 42 toward the base of the central slot 30. The resulting force, in conjunction with the force exerted by lateral pegs 24, forces ridges 32 on the boss 20 into mating grooves 29 in fin box 12C, securing the fore-aft position. The fin box 12C will have the central cavity 18 with an opening 122 at the end allowing the wedge locking member 114 to be inserted through the opening 122 prior to installation. FIG. 18 is a section through the second alternate embodiment of the fin box 12C illustrating the configuration of the wedge locking device 114.

Figure 19:
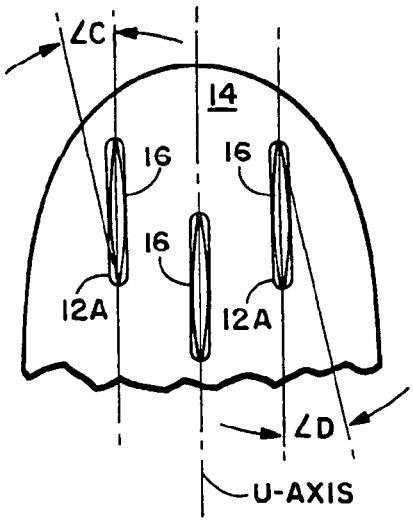
FIG. 19 is a view of the bottom aft section of a surfboard with a three fin arrangement.
Figure 20:
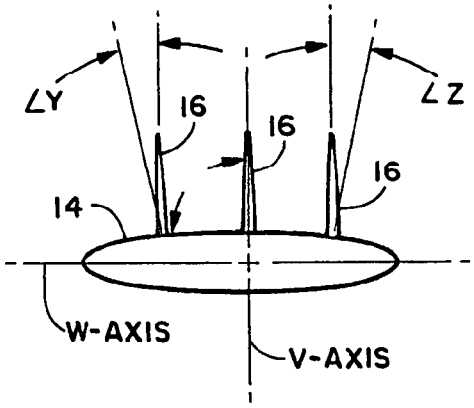
FIG. 20 is an aft end view of a surfboard with a three fin arrangement.

FIG. 19 is a view of the bottom aft section of the underside of a surfboard 14 with a three-fin arrangement showing optional angles C and D that are sometimes used with relation to the centerline U-axis of the surfboard. FIG. 20 is an aft end view of a surfboard 14 with a three-fin arrangement indicating the optional angles X, Y and Z with relation to the V-axis and the W-axis, often used on surfboards.

Figure 21:
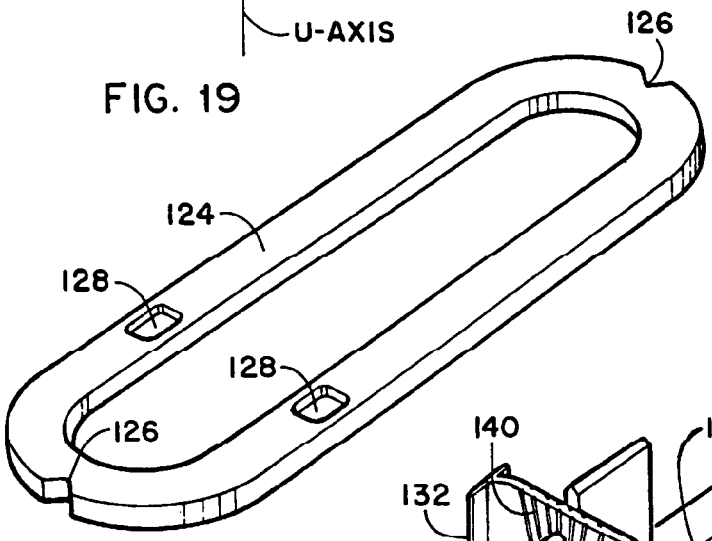
FIG. 21 is a perspective view of the router-jig/mounting-base.
Figure 22:
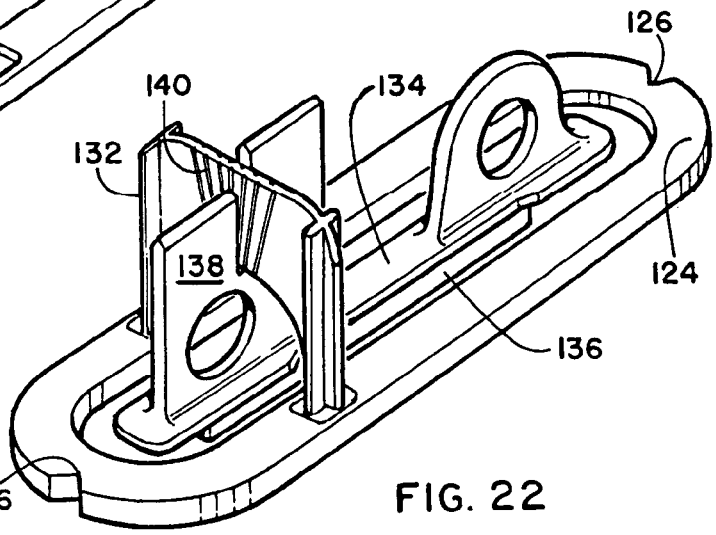
FIG. 22 is a perspective view of the router-jig/mounting-base with the fin angle position protractor and fin box locator in place.
Figure 23:
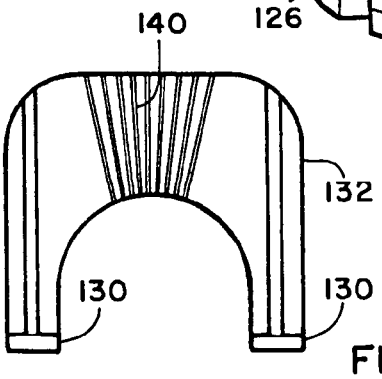
FIG. 23 is a view of the fin angle position protractor indicating the angular position grooves.

The fin-box installation system is defined in FIGS. 21, 22 and 23. FIG. 21 is a perspective view of the router jig 124 configured to be used to router out the mounting cavity 56. "V" grooves 126 are located at either end to locate the centerline of the fin box 12A, B, or C with the desired relationship to the U-axis of the surfboard. Locating orifices 128 are positioned to mount the legs 130 of the fin angle position protractor 132. FIG. 22 is a perspective view of the router jig 124 with the fin angle position protractor 132 and fin box locator 134 in place. The fin box locator 134 is equipped with a central slot cavity insert 136 to be inserted into the central slot cavity 18 of the fin box 12A, B or C for precise alignment and positioning. The angle alignment gage 138 determines the desired angle of the fin 16 by adjusting with relation to the angle position grooves 140 in the fin angle position protractor 132. FIG. 23 is a view of the fin angle position protractor 132 indicating the angle position grooves 140 and the legs 130.

The surfboard fin installation system shown in the drawings and described in detail herein disclose arrangements of elements of particular construction and configuration for illustrating preferred embodiments of structure and method of operation of the present invention. It is to be understood, however, that elements of different construction and configuration and other arrangements thereof, other than those illustrated and described may be employed for providing a surfboard fin installation system in accordance with the spirit of this invention, and such changes, alternations and modifications as would occur to those skilled in the art are considered to be within the scope of this invention as broadly defined in the appended claims.

We claim:

1. A surfboard fin box accepting a surfboard fin having lateral pegs on its side surfaces at one end and a locking arm at the other end comprising:

(a) a slot cavity housing having a forward end portion, a rearward end portion, and a base surface;

(b) a lateral "T" shaped slot in said forward end portion of said slot cavity housing defined by said slot cavity housing and said base surface whereby said lateral "T" shaped slot forms undercuts in each side of said slot cavity housing;

(c) a centralized slot cavity opening and a slot cavity defined by said slot cavity housing, said centralized slot cavity opening having opposing access grooves in the forward portion thereof, whereby said opposing access grooves are wider than said centralized slot cavity opening for the purpose of allowing similarly sized lateral pegs located on each side of said surfboard fin to enter or exit said lateral "T" shaped slot in said forward end portion of said slot cavity housing;

(d) a lateral "T" shaped slot in said rearward end portion of said slot cavity housing defined by said slot cavity housing and said base surface whereby said lateral "T" shaped slot forms undercuts in each side of said slot cavity housing;

(e) a cam action locking device with a lateral cam member located in said lateral "T" shaped slot in said rearward portion of said slot cavity housing for the purpose of engaging said locking arm and locking said surfboard fin in place within said slot cavity housing after said locking arm is inserted into said centralized slot cavity opening, whereby said surfboard fin is held securely in place for use.

2. The surfboard fin box for accepting a surfboard fin having lateral pegs on its side surfaces at one end and a locking arm at the other end, according to claim 1, wherein said surfboard fin may be installed or removed from said fin box without the use of any additional tool.

3. The surfboard fin box for accepting a surfboard fin having lateral pegs on its side surfaces at one end and a locking arm at the other end, according to claim 1, wherein said slot cavity housing includes a centralized slot cavity opening and a slot cavity defined by said slot cavity housing, said centralized slot cavity opening having opposing access grooves in the rearward portion thereof, whereby said opposing access grooves are wider than said slot cavity opening for the purpose of accepting a similarly sized lateral cam member located on said cam action locking device into said lateral "T" shaped slot in said rearward end portion of said slot cavity housing, thereby allowing installation and removal of said cam action locking device.

4. The surfboard fin box for accepting a surfboard fin having lateral pegs on its side surfaces at one end and a locking arm at the other end, according to claim 1, wherein said slot cavity housing includes one or more pivoting tabs located on said rearward and said forward ends for overlapping with the surface of a surfboard to locate said fin box correctly relative to said surfboard surface when said fin box is installed on said surfboard.

5. The surfboard fin box for accepting a surfboard fin having lateral pegs on its side surfaces at one end and a locking arm at the other end, according to claim 1, wherein said locking "T" shaped slot in the rearward end of said slot cavity housing is greater in height and longer in length than said "T" shaped slot in said forward end, such that said lateral pegs are inserted into said forward end before said locking arm is inserted into said rearward end.

6. The surfboard fin box for accepting a surfboard fin having lateral pegs on its side surfaces at one end and a locking arm at the other end, according to claim 1, wherein unwanted rearward or forward movement of said surfboard fin is inhibited by friction between the lower surface of the surfboard fin and said base surface of said slot cavity housing when locked.

7. The surfboard fin box for accepting a surfboard fin having lateral pegs on its side surfaces at one end and a locking arm at the other end, according to claim 6, wherein said base surface of said fin box has a plurality of ridges thereon, and said surfboard fin has mating ridges on its lower surface whereby engagement of mating ridges increases resistance to unwanted rearward or forward movement of said surfboard fin when locked.

8. The surfboard fin box for accepting a surfboard fin having lateral pegs on its side surfaces at one end and a locking arm at the other end, according to claim 6, wherein unwanted rearward or forward movement of said surfboard fin is inhibited when locked, and further wherein the position of said surfboard fin may be adjusted forwardly and rearwardly prior to being locked in place.

9. The surfboard fin box for accepting a surfboard fin having lateral pegs on its side surfaces at one end and a locking arm at the other end, according to claim 8, wherein said surfboard fin may be adjusted forwardly and rearwardly prior to being locked in place without the use of any additional tool.

10. The surfboard fin box for accepting a surfboard fin having lateral pegs on its side surfaces at one end and a locking arm at the other end, according to claim 1, wherein said cam action locking device includes a locking arm and a lateral cam member with a locking lobe and an orifice, whereby when properly positioned and said locking lever is pushed down into place, said locking lobe forces said locking arm into said fin box and said orifice mates securely with a raised detent on said locking arm, thereby locking said surfboard fin securely in place within said slot cavity.

11. The surfboard fin box for accepting a surfboard fin having lateral pegs on its side surfaces at one end and a locking arm at the other end, according to claim 1, wherein said cam action locking device includes a pivoting cam action member having a handle and a disk element, whereby when properly positioned and said pivoting cam action member is rotated into place and said disk element mates securely with a locking arm on the surfboard fin, thereby locking said surfboard fin securely in place within said slot cavity.

12. The surfboard fin box for accepting a surfboard fin having lateral pegs on its side surfaces at one end and a locking arm at the other end, according to claim 11, having a circular shaped slot for accepting said cam action locking device, thereby allowing installation and removal of said cam action locking device.

13. The surfboard fin box for accepting a surfboard fin having lateral pegs on its side surfaces at one end and a locking arm at the other end, according to claim 1, wherein said cam action locking device includes a wedge locking member having a handle and a plurality of grooves on its lower surface, whereby when properly positioned and said wedge locking member is pushed into place and said plurality of grooves mates securely with a stop on the surfboard fin, thereby locking said surfboard fin securely in place within said slot cavity.

14. A method of making a surfboard fin box accepting a surfboard fin having lateral pegs on its side surfaces at one end and a locking arm at the other end, comprising the steps of:

(a) providing a slot cavity housing having a forward end portion, a rearward end portion, and a base surface;

(b) providing a lateral "T" shaped slot in said forward end portion of said slot cavity housing defined by said slot cavity housing and said base surface whereby said lateral "T" shaped slot forms undercuts in each side of said slot cavity housing;

(c) providing a centralized slot cavity opening and a slot cavity defined by said slot cavity housing, said centralized slot cavity opening having opposing access grooves in the forward portion thereof, whereby said opposing access grooves are wider than said slot cavity opening for the purpose of allowing similarly sized lateral pegs located on each side of said surfboard fin to enter or exit said lateral "T" shaped slot in said forward end portion of said slot cavity housing;

(d) providing a lateral "T" shaped slot in said rearward end portion of said slot cavity housing defined by said slot cavity housing and said base surface whereby said lateral "T" shaped slot forms undercuts in each side of said slot cavity housing;

(e) providing a cam action locking device with a lateral cam member located in said lateral "T" shaped slot in said rearward portion of said slot cavity housing for the purpose of engaging said locking arm and locking said surfboard fin in place within said slot cavity housing after said locking arm is inserted into said centralized slot cavity opening, whereby said surfboard fin is held securely in place for use.

15. The method for making surfboard fin box accepting a surfboard fin having lateral pegs on its side surfaces at one end and a locking arm at the other end, according to claim 14, wherein said step of providing a slot cavity housing having a forward end portion, a rearward end portion, and a base surface further includes said step wherein said base surface includes a plurality of mating ridges to engage the mating ridges on the lower surface of the surfboard fin to prevent unwanted rearward or forward movement of said surfboard fin when locked.

16. The method for making a surfboard fin box accepting a surfboard fin having lateral pegs on its side surfaces at one end and a locking arm at the other end, according to claim 14, wherein said step of providing a slot cavity housing having a forward end portion, a rearward end portion, and a base surface further includes said step wherein said base surface is smooth and wherein unwanted rearward or forward movement of said surfboard fin is inhibited by friction between the lower surface of the surfboard fin and said base surface of said slot cavity housing when locked.

17. The method for making a surfboard fin box accepting a surfboard fin having lateral pegs on its side surfaces at one end and a locking arm at the other end,, according to claim 15, wherein said step of providing a slot cavity housing having a forward end portion, a rearward end portion, and said base surface with a plurality of mating ridges thereon includes said plurality of mating ridges engaging the mating ridges on the lower surface of the surfboard fin prevent unwanted rearward or forward movement of said surfboard fin when locked, and further wherein the position of said surfboard fin may be adjusted forwardly and rearwardly prior to being locked in place without the use of any additional tool.

18. The method for making a surfboard fin box accepting a surfboard fin having lateral pegs on its side surfaces at one end and a locking arm at the other end, according to claim 16, wherein said step of providing a slot cavity housing having a forward end portion, a rearward end portion, and said smooth base surface engages the lower surface of the surfboard fin to prevent unwanted rearward or forward movement of said surfboard fin when locked, and further wherein the position of said surfboard fin may be adjusted forwardly and rearwardly prior to being locked in place without the use of any additional tool.

19. The method for making a surfboard fin box accepting a surfboard fin having lateral pegs on its side surfaces at one end and a locking arm at the other end, according to claim 14, wherein said step of providing a cam action locking device with a lateral cam member located in said lateral "T" shaped slot in said rearward portion of said slot housing cavity includes the step of providing a cam action locking device having a locking arm and a lateral cam member with a locking lobe and an orifice, whereby when properly positioned and said locking lever is pushed down into place, said locking lobe forces said locking arm into said fin box and said orifice mates securely with a raised detent on said locking arm, thereby locking said surfboard fin securely in place within said slot cavity.

20. The method for making a surfboard fin box accepting a surfboard fin having lateral pegs on its side surfaces at one end and a locking arm at the other end,, according to claim 14, wherein said step of providing a cam action locking device with a lateral cam member located in said lateral "T" shaped slot in said rearward portion of said slot housing cavity includes the step of providing a cam action locking device having a pivoting cam action member having a handle and a disk element, whereby when properly positioned and said pivoting cam action member is rotated into place and said disk element mates securely with a locking arm on the surfboard fin, thereby locking said surfboard fin securely in place within said slot cavity.

21. The method for making a surfboard fin box accepting a surfboard fin having lateral pegs on its side surfaces at one end and a locking arm at the other end, according to claim 20, wherein said step of providing a lateral "T" shaped slot in said rearward end portion of said slot cavity housing is replaced by the step of providing a circular shaped slot in said rearward end portion of said slot cavity housing for the purpose of accepting a rotational cam locking device, thereby allowing installation and removal of said cam action locking device.

22. The method for making a surfboard fin box accepting a surfboard fin having lateral pegs on its side surfaces at one end and a locking arm at the other end, according to claim 14, wherein said step of providing a cam action locking device with a lateral cam member located in said a lateral "T" shaped slot in said rearward portion of said slot housing cavity includes the step of providing a wedge locking member having a handle and a plurality of grooves for the purpose of mating securely with a stop on the surfboard fin, thereby locking said surfboard fin securely in place within said slot cavity.

23. The method for making a surfboard fin box accepting a surfboard fin having lateral pegs on its side surfaces at one end and a locking arm at the other end,, according to claim 22, wherein said step of providing a lateral "T" shaped slot in said rearward end portion of said slot cavity housing is omitted, whereby said slot cavity opening has only one "T" shaped slot in the forward position.

24. A fin box installation system for installing a surfboard fin mounting box for accepting a surfboard fin having lateral pegs lateral pegs on its side surfaces at one end and a locking arm at the other end, comprising:

(a) a router jig having two longitudinally centralized "V" grooves and one or more locating orifices;

(b) a fin box locator having a central slot cavity insert and an angle alignment gage;

(c) a fin angle position protractor having legs and angle position grooves thereon;

(d) whereby when said fin box installation system is attached to the surface of a surfboard it acts as a router jig to router out the fin box mounting cavity; wherein said "V" grooves are used to locate the centerline of said fin box with the desired relationship to the center axis of the surfboard, said locating orifices are positioned to mount the said legs of said fin angle position protractor, and said fin box locator is equipped with said central slot cavity insert to be inserted into the central slot cavity of the fin box for precise alignment and positioning, and further wherein said angle alignment gage is aligned with desired angle position groove within said fin angle position protractor to achieve the desired angle of the fin.

* * * * *